US006942024B2

(12) United States Patent
Nies

(10) Patent No.: US 6,942,024 B2
(45) Date of Patent: Sep. 13, 2005

(54) CORRUGATED HEAT EXCHANGE ELEMENT

(75) Inventor: Jens Nies, Holzgerlingen (DE)

(73) Assignee: Modine Manufactruing Company, Racine, WI (US)

( * ) Notice: Subject to any disclaimer, the term of this patent is extended or adjusted under 35 U.S.C. 154(b) by 80 days.

(21) Appl. No.: 10/424,619

(22) Filed: Apr. 28, 2003

(65) Prior Publication Data

US 2003/0213588 A1 Nov. 20, 2003

(30) Foreign Application Priority Data

Apr. 27, 2002 (DE) ..... 102 18 912

(51) Int. Cl.[7] ..... F28F 13/12
(52) U.S. Cl. ..... 165/152; 165/183
(58) Field of Search ..... 165/135, 140, 165/152, 153, 183

(56) References Cited

U.S. PATENT DOCUMENTS

| | | | | | |
|---|---|---|---|---|---|
| 3,298,432 | A | | 1/1967 | Przyborowski | |
| 5,029,636 | A | * | 7/1991 | Kadle | 165/183 |
| 5,033,540 | A | * | 7/1991 | Tategami et al. | 165/153 |
| 5,036,911 | A | * | 8/1991 | So et al. | 165/153 |
| 5,476,140 | A | * | 12/1995 | Lu | 165/152 |
| 6,073,686 | A | * | 6/2000 | Park et al. | 165/153 |
| 6,662,861 | B2 | * | 12/2003 | Ozaki et al. | 165/140 |
| 2002/0124999 | A1 | * | 9/2002 | Chiba | 165/153 |
| 2003/0075307 | A1 | * | 4/2003 | Stoynoff et al. | 165/135 |

FOREIGN PATENT DOCUMENTS

| | | |
|---|---|---|
| DE | 3641 405 A1 | 7/1987 |
| DE | 690 05 204 T2 | 6/1994 |
| DE | 195 03 766 C2 | 5/1996 |
| DE | 693 06 155 T2 | 5/1997 |
| DE | 694 04 868 T2 | 2/1998 |
| DE | 196 52 999 A1 | 6/1998 |
| DE | 694 08 708 T2 | 9/1998 |
| DE | 198 40 912 A1 | 3/2000 |
| DE | 199 63 373 A1 | 7/2001 |
| DE | 100 41 919 C1 | 10/2001 |

* cited by examiner

*Primary Examiner*—Teresa J. Walberg
(74) *Attorney, Agent, or Firm*—Wood, Phillips, Katz, Clark & Mortimer

(57) ABSTRACT

The invention concerns a corrugated heat exchanger element (1) that can be produced from a metal strip and has a corrugation height (h) that lies between the crests (2) of the corrugations, in which the crests (2) form a first and second plane, consisting of several crests (2), at least some of the crests (2) of each plane being connected to the heat exchanger walls (3), and in which each crest (2) of the first plane is connected to the following crest (2) of the second plane by means of flanks (4), and a flow channel (20) is formed between adjacent flanks (4); structures (5), whose direction of alignment (15) in one flank (4) intersects the direction of alignment (15) in the following flank (4), are situated in the flanks (4). In order to improve the efficiency of heat exchange, it is proposed in a first variant according to the invention that the elements of structures (5) be beads (6) or corrugations or the like that provide the flow channel with alternating constrictions (11) and widenings (10), the adjacent flow channels (20) being essentially separated from each other in terms of flow. A second variant according to the invention proposes that the elements of the structures (5) be cuts (7) that connect the adjacent flow channels (20) together in terms of flow. A third variant prescribes that the elements of the structures be beads (6) or corrugations, in which cuts (7) lying in the direction of alignment (15) of the beads (6) or corrugations are arranged.

6 Claims, 5 Drawing Sheets

H
α
α
1
2
3
4
5
5(6)
10
11
14
15
16
20

CORRUGATED HEAT EXCHANGE ELEMENT

FIELD OF THE INVENTION

The invention concerns a corrugated heat exchange element.

BACKGROUND OF THE INVENTION

Corrugated heat exchange elements in the present sense are the so-called corrugated ribs that are inserted in air-cooled radiators between the flat tubes arranged in a row, in order to guarantee heat exchange between the medium in the flat tubes and the cooling air flowing through the corrugated ribs. The mentioned heat exchanger walls are the broad sides of the flat tubes in this case. The crests are designed arc-like.

Other corrugated heat exchange elements are often referred to as sheets, or also as internal inserts, and are situated within the tubes or in channels formed by plates, for example, in plate heat exchangers that are encountered as oil coolers or the like. In such cases, the heat exchanger walls are the individual plates stacked one in the other. The crests are generally bent in a U-shape.

The heat exchanger elements (corrugated ribs) defined in the preamble are known from U.S. Pat. No. 3,298,432. The structures in the flanks in the US document are very fine ribs that run obliquely in the fashion of a herringbone pattern. The pattern is embossed into the metal strip and the corrugated shape of the corrugated rib is then produced, so that the alignment direction of the structures in one side intersects the alignment direction of the structures in the following side. Since the structures in the US document are supposed to be very fine, improved efficiency of heat exchange is produced in the region near the wall, but a detectable additional effect can scarcely be established by their intersection. Because the pattern is embossed flat in the entire metal strip, it is also located at the crests of the corrugated rib, so that the heat-conducting connection with the heat exchanger walls can be adversely affected. In addition, this very fine structuring can lead to a poor soldering result.

The corrugated ribs in DE 195 03 766 C2 have a similar herringbone structure, in which several herringbone structures are arranged one behind the other there, because of the greater width of the metal strip, so that parallel zigzag lines are produced. The herringbone pattern is much coarser than that from the first-named document. Intersection of the alignment direction from flank to flank is not prescribed in the German document.

The described heat exchanger elements according to the task of the present invention are supposed to be modified so that they offer an additional improvement with respect to heat exchange efficiency.

SUMMARY OF THE INVENTION

This task is solved according to three solution proposals which satisfy the task independently. In these solutions, a corrugated heat exchanger element may be produced from a metal strip and has a corrugation height (h) that lies between the crests of the corrugations, The crests form first and second planes that consist of several crests, in which at least some crests of each plane are to be joined to heat exchanger walls. Each crest of the first plane is connected to the following crest of the second plane by means of flanks, and a flow channel is formed between adjacent flanks. The corrugated heat exchanger element comprising structures situated in flanks and whose direction of alignment in one flank intersects with the direction of alignment in the following flank.

According to one solution, it is proposed that the elements of the structures be beads or corrugations or the like that provide the flow channel with alternating constrictions and widenings, in which adjacent flow channels are essentially separated from each other in terms of flow.

It was found that heat exchanger elements designed in this way have better heat transfer. This could be attributed to the fact that the stream passing through the flow channel between the flanks is displaced in rotation so that exchange with the flow near the wall is improved.

If the elements of the structures are beads or corrugations that point into the flow channel, as is apparent from cross sections taken at different heights through the flow channel, constrictions and widenings of the flow channel are obtained in alternation, viewed in the direction of flow, to which a favorable effect can be assigned.

According to the second solution, the elements of the structures are cuts that connect, in terms of flow, the adjacent flow channels. It was found that such cuts intersecting from flank to flank in their direction of alignment can make a contribution to improved heat transfer. The cuts themselves are of known nature and are bent out from the surface of the flank, so that openings that connect the adjacent flow channels together are produced in the flank.

According to the third solution, the elements of the structures are beads or corrugations, in which cuts lying in the direction of alignment of the beads or corrugations are arranged. The cuts can be situated in the corrugation troughs or in the corrugation peaks, or at any location within the corrugation.

The cuts are provided in known fashion with a setting angle to the flank surface, in order to generate turbulent flow. The cuts of the invention preferably have the same setting angle within a flank, and also in adjacent flanks. The beads and cuts have the same alignment direction, so that, viewed in a cross section, the cuts and beads are arranged parallel to each other in the flanks. The alignment directions of the cuts and beads intersect in adjacent flanks.

It is also considered advantageous that, in several groups of oblique structures, opposite slope angles of the oblique structures in one flank are provided from one group to the next group, in which, between the groups, the flanks are formed either without structure or, if necessary, can have stiffening elements.

The length of the elements of the structures is shorter at the beginning and end than in the main structure region connected to them, in order to utilize the surface of the flanks as optimally as possible.

The length of the elements in the main structure region should preferably be equally large and amount to at least 70% of the corrugation height.

The slope angle of the oblique structures relative to the vertical is preferably no greater than 45°. With this feature, the most extensive possible utilization of the surface of the flanks is also sought for alignment of the structures.

The invention is described below in three practical examples.

Other objects and advantages will become apparent from the following specification taken in connection with the accompanying drawings.

DETAILED DESCRIPTION OF THE PREFERRED EMBODIMENTS

The depicted heat exchanger elements were produced from an aluminum strip. However, they could also be made of another appropriate metal. Production is carried out so that the structures 5 are initially embossed into the metal strip, structures 5 having a spacing from each other in the longitudinal direction of the strip. The size of the spacing corresponds in the practical example from FIGS. 1 to 6 to roughly the later crests 2 that are subsequently created by bending the strip in the transverse direction. Only a single corrugation was shown in the practical examples, but it is absolutely clear that the heat exchanger element 1 consists of an arbitrary number of corrugations, so that a first and second plane formed from the crests 2 are present.

Figures 1, 2, 3, 4, 5:
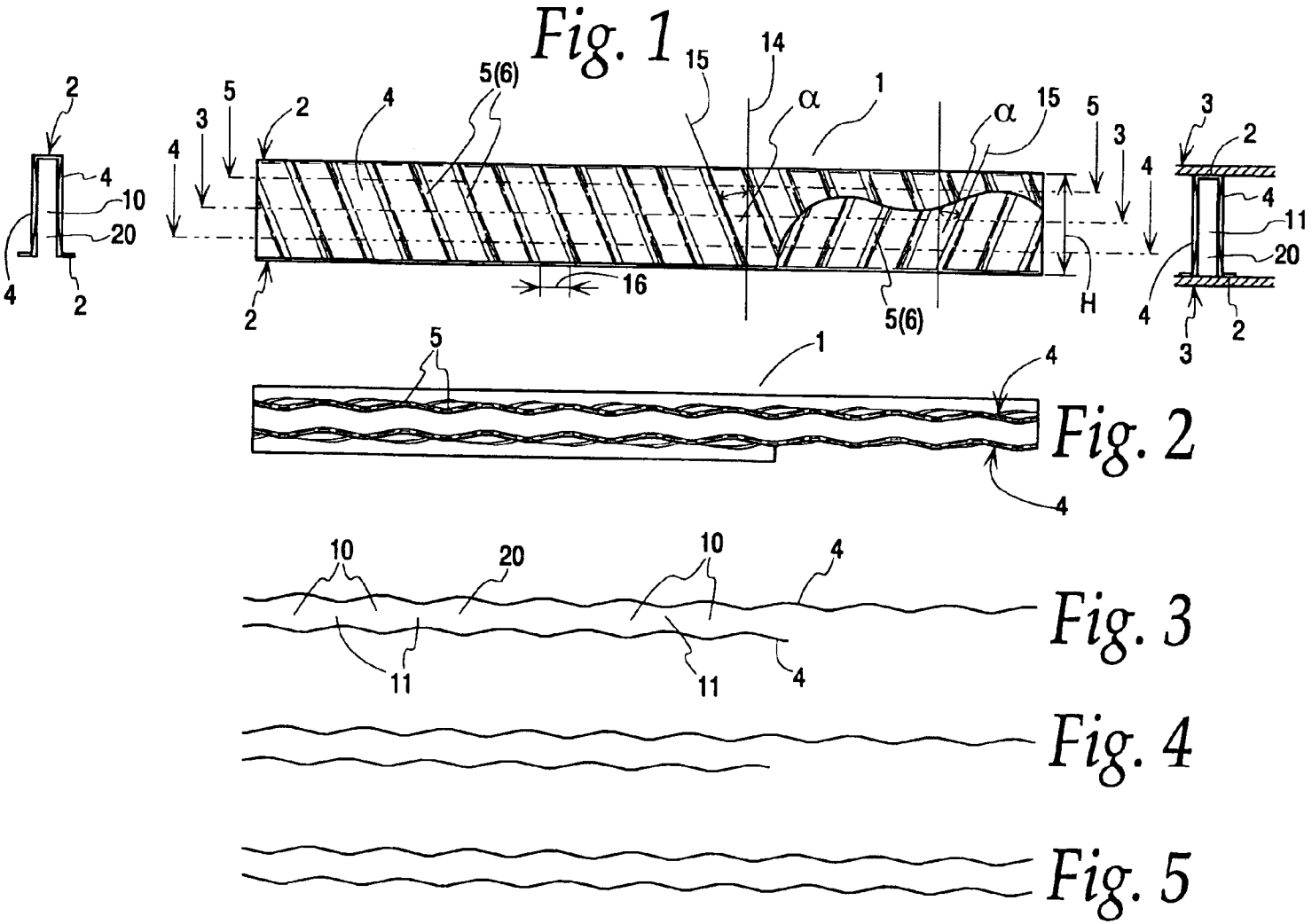
FIG. 1 is a side view of a plate.
FIG. 2 is a top view of the plate from FIG. 1.
FIG. 3 shows section 3—3 from FIG. 1.
FIG. 4 shows section 4—4 from FIG. 1.
FIG. 5 shows section 5—5 from FIG. 1.
Figure 6:
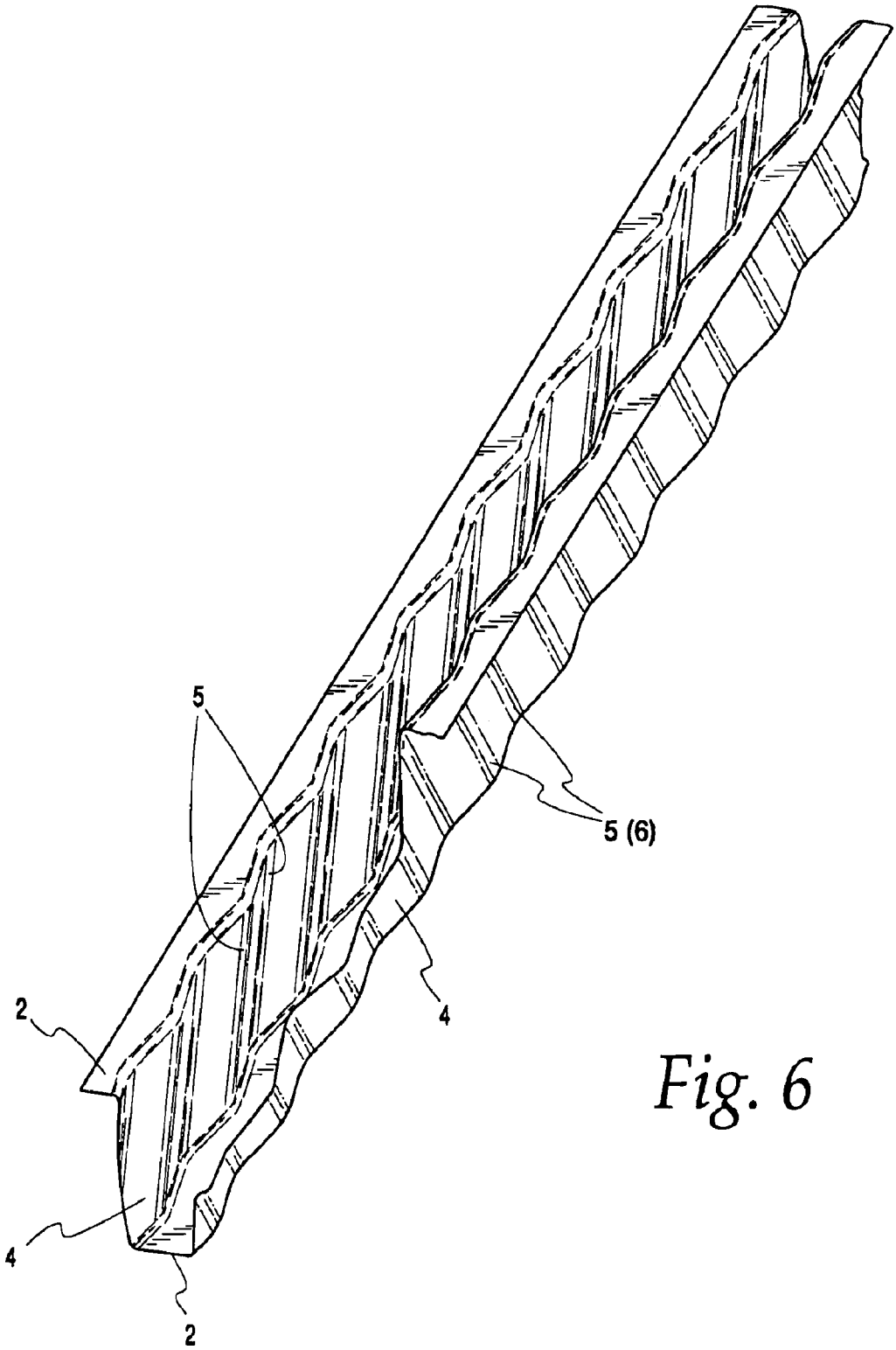
FIG. 6 is a perspective view of this plate.
Figure 9:
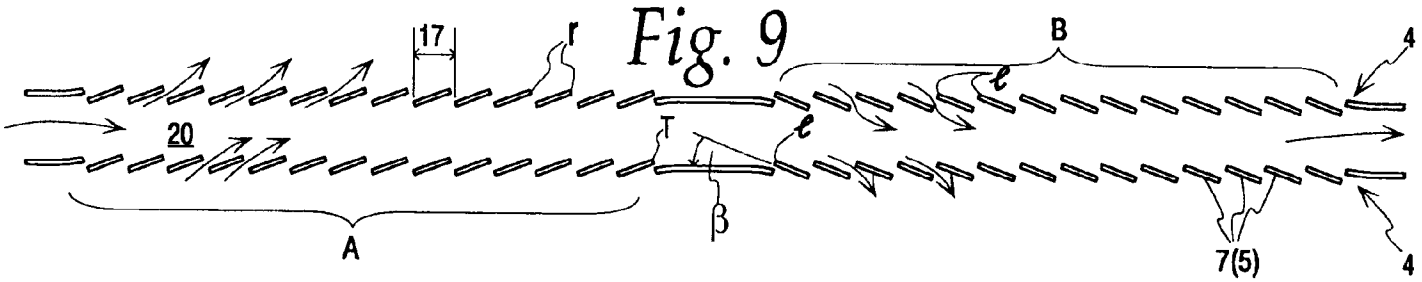
FIG. 9 shows section 9—9 from FIG. 7.

The practical example from FIGS. 1 to 6 shows a sheet arranged as an internal insert in a channel of an oil cooler, which, however, was not shown in detail, because the alignment of sheets in heat exchangers made from stacked plates represents a well known expedient. FIG. 1 also includes front views of the left and right ends of the plate in the figure. Only one heat exchanger wall 3 each is shown in the top and bottom in the right view of FIG. 1, which is one of the already mentioned plates, and which is arranged in the mentioned first and second planes. The mentioned channel in which the oil flows in an oil cooler is formed between the two heat exchanger walls 3. The coolant flows in the adjacent upper and lower channels (not shown), which could be identical. The oblique structures 5 in the flanks 4 of heat exchanger element 1 in this practical example are beads 6. For reasons of clarity, beads 6 are also discussed in the description, although the sequential alignment as a corrugation of the flanks 4 can also be considered. The beads 6 in one flank 4 have a spacing 16 from each other, in which the spacing 16 in all flanks 4 should preferably be equally large. In terms of magnitude, the spacing 16 lies in the range of about 10 mm and in other applications will also be larger or somewhat smaller. In any case, very fine ribbing is not involved here, as that in U.S. Pat. No. 3,298,432, which only produces surface roughness. It is apparent from FIG. 1 that the beads 6 in the front flank 4 are sloped to the left to the vertical 14. In the rear flank 4, which is only partially visible, the beads 6 are sloped to the right, so that the direction of alignment 15 of beads 6 on the front flank 4 intersects the alignment direction 15 of the beads 6 on the rear flank 4. In the practical example, the slope angle $\alpha$ of the beads 6 to the vertical 14 is roughly the same in the front and rear flanks 4. Intersection of the alignment direction 15, however, is also obtained, for example, when the beads 6 are tilted in only one of the flanks 4 by the slope angle $\alpha$ and are arranged in the direction of vertical 14 in the other flank 4. Consequently, in the present case, only a preferred practical example is involved. As is apparent from FIG. 3, by the described alignment of beads 6 between the two flanks 4, which delimit a flow channel 20, widenings 10 and constrictions 11 of flow channel 20 are produced in the flow direction. This can also be recognized by comparison of the left and right front views of the ends of the plate in FIG. 1. In the left view, a widening 10 can be seen, whereas in the right view a constriction 11 is apparent. The most conspicuous size difference between the widenings 10 and the constrictions 11 is produced roughly at half the corrugation height h, in which the section 3—3 depicted in FIG. 3 is found. As clearly shown by FIGS. 4 and 5 (sections 5—5 and 4—4), on the top and bottom there is less of a difference between the constrictions 11 and the widenings 10, so that more of a corrugated flow channel 20 with almost parallel flanks 4 can be seen there. The beads 6 extend over the entire spacing between the first and second planes formed from the crests 2. The length L of the beads 6, however, is greater than the mentioned corrugation height h between these planes, because of their oblique position. The crests 2 have a roughly u-shaped cross section and are not beaded, as is apparent from the top view of FIG. 2.

The second practical example is depicted in FIGS. 7 to 10. This involves a corrugated rib, traversed by cooling air and arranged between the flat tubes of an air-cooled heat exchanger.

In this practical example, the spacing between structures 5 (7) in the longitudinal direction of the strip present in the premanufacturing stage of the corrugated rib is much greater than the arc dimension of the crests 2, which are designed roughly semicircular. It is therefore apparent in FIGS. 7 and 10, for example, that the structures 5 (7) do not extend directly to the crests 2 on the top and bottom, but end distinctly before it.

Figure 10:
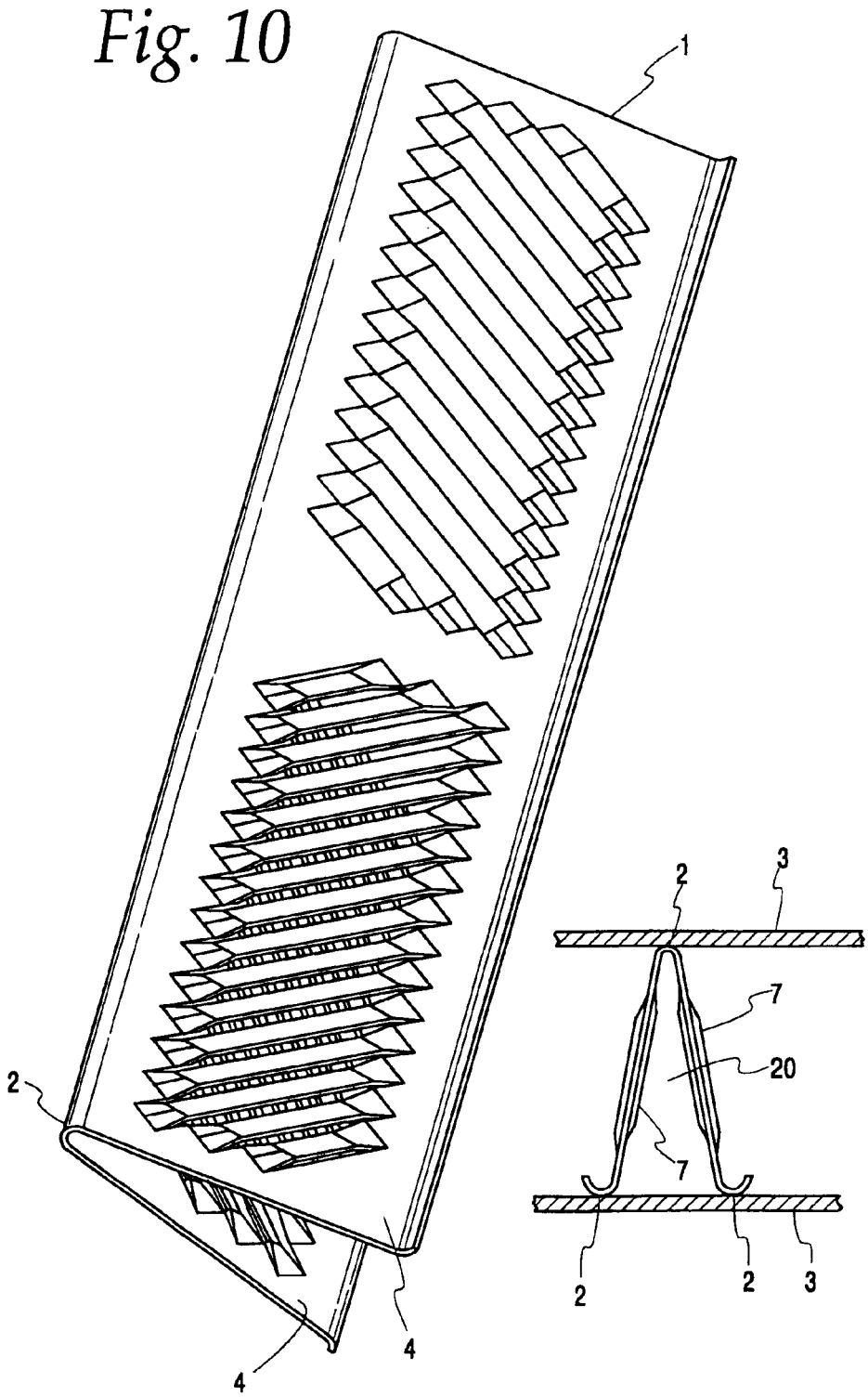
FIG. 10 is a perspective view of the corrugated rib.

Two heat exchanger walls 3 were shown in FIG. 10, each of which is supposed to represent a broad side of the flat tube. (not shown). A flow channel 20 is situated between adjacent flanks 4. The corrugated rib is provided with cuts 7 in its flanks 4, in which the alignment direction 15 of cut 7 in one flank 4 intersects the alignment direction 15 of cut 7 in the adjacent flank 4. As is apparent from the mentioned figures, two groups A, B of cuts 7 are provided in this practical example, without the number of groups being restricted to two. The cuts 7 in both groups A and B have the same slope angle $\alpha$, but are sloped oppositely. The preceding description follows, in particular, from FIG. 7, which shows the rear flank 4 (in the figure) on the right side in a cutout. In the A-group, the cuts 7 are sloped to the right, and in the B-group to the left. A region 13, in which the flanks 4 are formed without structure, is present between the two groups A and B. A stiffening bead is situated in region 13 in practical examples not shown. In other undepicted practical examples, this region 13 can be cut out, in order to better separate the two groups A and B from each other thermally. In such cases, two different heat exchangers are involved, in which group A belongs to the first heat exchanger and group B to the second heat exchanger. As is particularly apparent in FIG. 9, the cuts 7 within groups A and B are arranged parallel to each other in flanks 4, i.e., they were produced in the same direction from the surface of flanks 4. All cuts 7 also have an equally large setting angle $\beta$. However, the cuts 7 in group A were produced to the right r and in group B to the left 1, so that an air stream (arrow) entering the flow channel 20 in group A is essentially guided upward into the connected flow channel 20 (not shown) and in group B downward into the flow channel 20 (also not shown).

Figure 7:
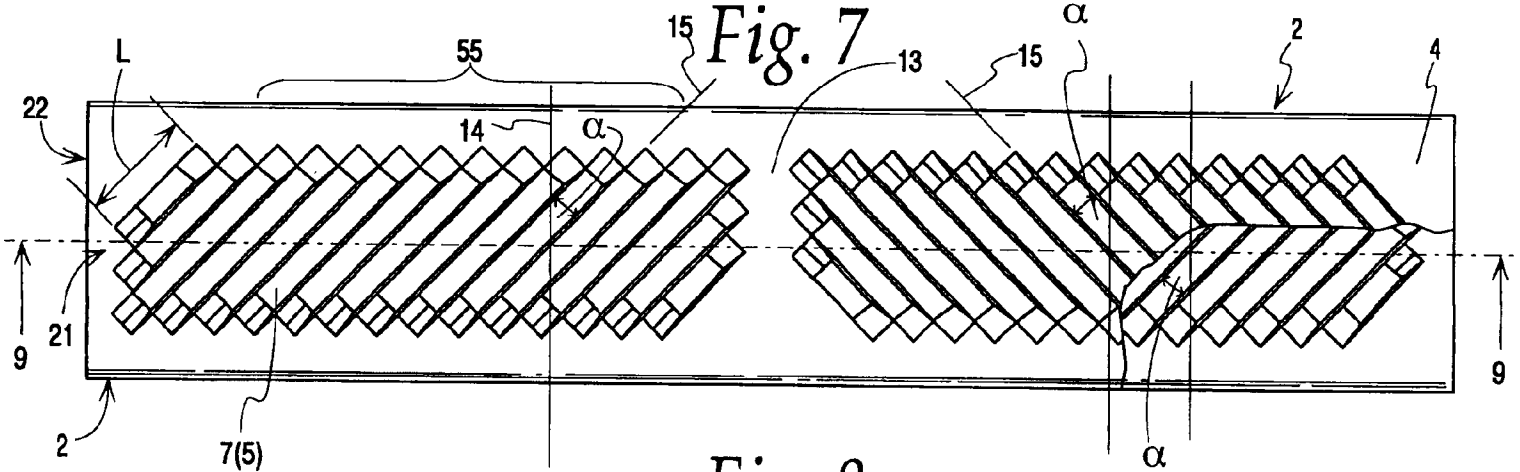
FIG. 7 is a side view of a corrugation rib.
Figure 8:
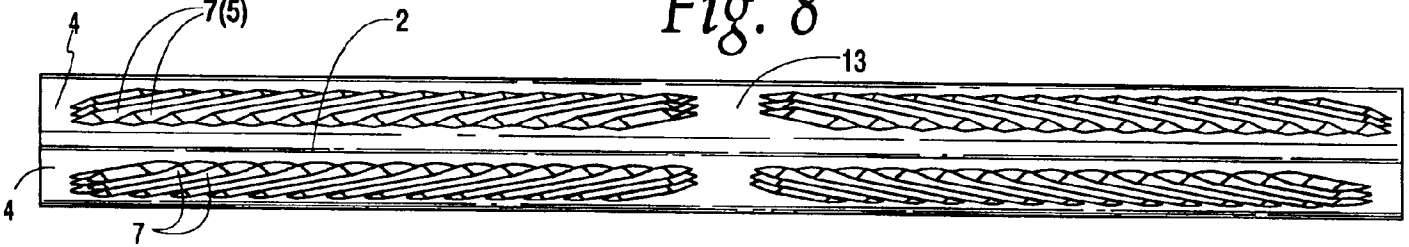
FIG. 8 is a top view.

As is apparent from FIG. 7, the length L of cut 7 at the beginning and end of groups A and B is shorter than in the main structure region 55, which begins here with the third cut 7. The cut 7 should end before region 21 in front of the edge 22 of flank 4, in order to achieve sufficient rigidity of the corrugated rib.

Figure 11A:
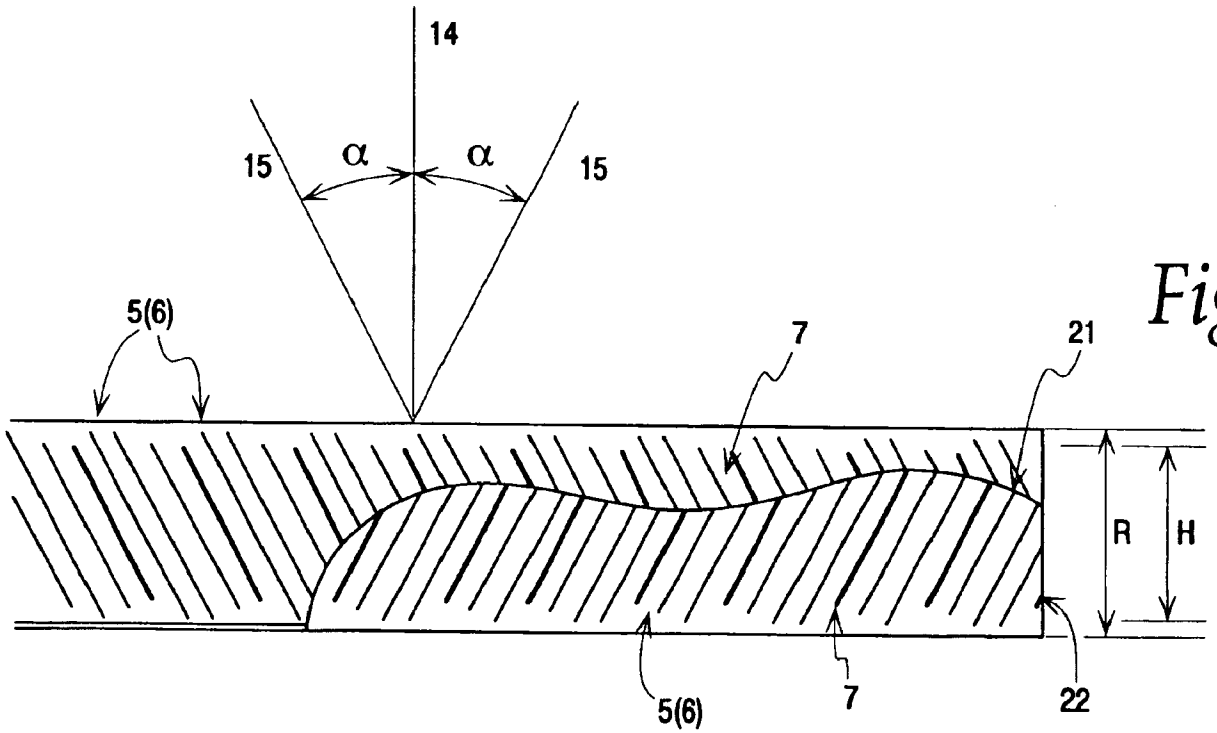
FIG. 11 is a side view (a) and top view (b) of a plate with corrugations and cuts.
Figure 11B:
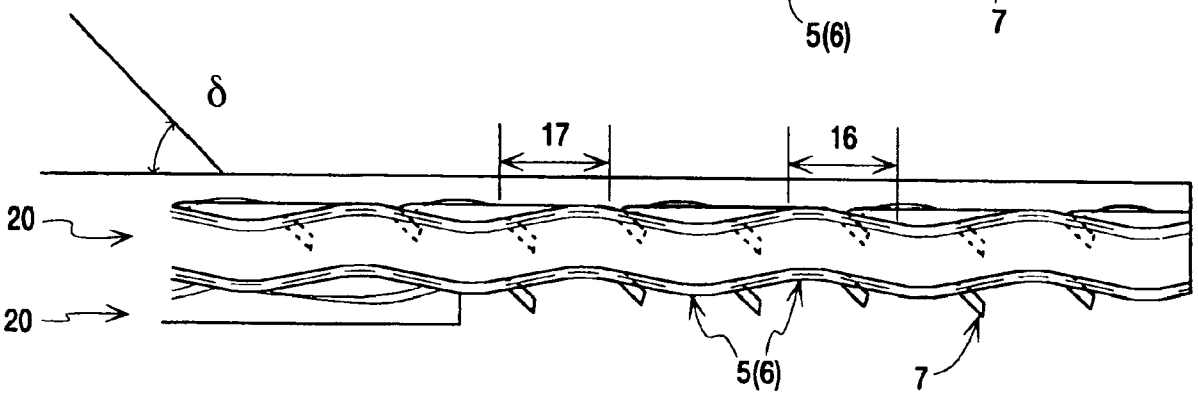

In a third practical example (see FIGS. 11 a and 11 b), a sheet is involved, as described in the first practical example. It can be traversed by cooling air, and also by oil. The sheet is used in one channel of the heat exchange element. Here a sheet having structures 5 (6, 7) is involved. These structures 5 (6, 7), whose direction of alignment 15 with the vertical 14 encloses the slope angle α, are arranged parallel to each other on one flank 4. However, in the opposite flanks 4, the corresponding alignment directions 15 intersect. The peculiar feature of these sheets is that they have cuts 7, in addition to beads 6. Because of the turbulence produced by this, the heat exchange efficiency can be further improved. The cuts 7 are all produced from the sheet at the same angle δ, so that the medium flowing through them can go from one flow channel 20 into the adjacent flow channels 20. The height H of the cuts 7 is smaller than the corrugation height R of the sheet, in order to guarantee sufficient stability of the sheet. The spacing 17 of the cuts should preferably be as large as the spacing 16 of the beads 6. In the depicted practical example, the cuts 7 lie between the individual beads 6, but can also be situated in other positions on flank 4. Depicting this in detail was dispensed with. The cuts 7 should extend in region 21 in front of the edge 22, in contrast to beads 6 so that the last cuts 7 are shorter than the cuts 7 in the main structure region 55.

What is claimed is:

1. A corrugated heat exchanger element that can be produced from a metal strip and has a corrugation height (h) that lies between the crests of the corrugations, in which the crests form a first and second plane that consist of several crests, at least some of the crests of each plane being connected to heat exchanger walls, and in which each crest of the first plane is connected to the following crest of the second plane by means of flanks, and a flow channel is formed between adjacent flanks; the corrugated heat exchanger element comprising structures situated in flanks and whose direction of alignment in one flank intersects with the direction of alignment in the following flank, elements of the structures including cuts that connect the adjacent flow channels together in terms of flow, said cuts lying in said direction of alignment in each of said flanks, wherein the structures are arranged in several groups, in which opposite slope angles (α) of structures in one flank are provided from one group to the next group, and in which the flanks are formed either without structure between the groups or can have stiffening elements.

2. A corrugated heat exchanger element according to claim 1 wherein the direction of alignment of the structures of the aligned groups in the following flank have opposite, but approximately equally large angles (α).

3. A corrugated heat exchanger element according to claim 2 wherein the slope angle (α) of the structures relative to vertical is substantially no greater than 45°.

4. A corrugated heat exchanger element according to claim 1 wherein the length (L) of the elements of structures is shorter at their beginning and end than in a main structure region connected to them.

5. A corrugated heat exchanger element according to claim 4 wherein the length (L) of the elements in the main structure region amounts to at least 70% of the corrugation height (h).

6. A corrugated heat exchanger element according to claim 1 wherein the two planes formed by the crest are arranged either parallel to each other or can have a diminishing or increasing spacing relative to each other.

* * * * *